US008474262B2

(12) United States Patent
Regelman et al.

(10) Patent No.: US 8,474,262 B2
(45) Date of Patent: Jul. 2, 2013

(54) ADVANCED TANDEM ORGANIC RANKINE CYCLE

(76) Inventors: Yakov Regelman, Newton, MA (US); Yuriy Cherepashenets, Newton, MA (US)

( * ) Notice: Subject to any disclaimer, the term of this patent is extended or adjusted under 35 U.S.C. 154(b) by 108 days.

(21) Appl. No.: 13/136,609

(22) Filed: Aug. 5, 2011

(65) Prior Publication Data

US 2012/0047890 A1 Mar. 1, 2012

Related U.S. Application Data

(60) Provisional application No. 61/402,111, filed on Aug. 24, 2010.

(51) Int. Cl.
*F01K 25/08* (2006.01)

(52) U.S. Cl.
USPC ..... 60/651; 60/671

(58) Field of Classification Search
USPC ..... 60/651, 671, 641.4, 682
See application file for complete search history.

(56) References Cited

U.S. PATENT DOCUMENTS 4,166,362 A * 9/1979 Laurent ..... 60/39.181
4,503,682 A * 3/1985 Rosenblatt ..... 60/671
4,982,568 A * 1/1991 Kalina ..... 60/649
5,570,579 A * 11/1996 Larjola ..... 60/651
6,571,548 B1 * 6/2003 Bronicki et al. ..... 60/772
6,735,948 B1 * 5/2004 Kalina ..... 60/649
6,857,268 B2 * 2/2005 Stinger et al. ..... 60/651
7,096,665 B2 * 8/2006 Stinger et al. ..... 60/651
7,356,993 B2 * 4/2008 Smith ..... 60/651
7,942,001 B2 * 5/2011 Radcliff et al. ..... 60/651
2008/0289313 A1 11/2008 Batscha
2010/0071368 A1 3/2010 Kaplan
2010/0242479 A1 9/2010 Ast
2010/0263380 A1 10/2010 Biederman

OTHER PUBLICATIONS

F. David Doty, Siddarth Shevgoor "A dual-source organic Rankine cycle (DORC) for improved efficiec=ncy in conversion of dual low-andmid-grade heat sources", ASME 2009, 3 INCE.
G. Angelino, P.Colonna Di Paliano "Organic Rankine Cycles (ORCS) for energy recovery from molten carbonate fuel cells", 35th Intersociety Energy Conversion Engineering, 2000.
H.M.Leibowitz "Generating Electric Power from Compressor Station Residual Heat using ORC Technology", Presentation, Manager of the Heat Recovery Systems, Ormat Inter., 2002.
E. Lemmon "Thermodynamic Properties of Propane. III A Reference Equiation of State for Temperatures from Melting Line to 650 K and Pressure up to 1000 MPA" J.ChEng. Data, 2009.

* cited by examiner

*Primary Examiner* — Thomas Denion
*Assistant Examiner* — Shafiq Mian

(57) ABSTRACT

Advanced Tandem Organic Rankine Cycle (AT ORC) is described for recovering power from source of heat energy into two separated independent cycles with organic fluid of propane or mix of light hydrocarbons with similar thermal stability, namely the high temperature cycle realized in the high temperature closed loop thermally connected to the high temperature zone, and the low temperature cycle realized in the low temperature closed loop thermally connected to the low temperature zone of the source of heat energy. In the process of each cycle, organic fluid changes phases from pressurized liquid to pressurized superheated organic vapor using residual heat energy from depressurized superheated organic vapor, and heat energy from corresponding temperature zone. Separation of the source of heat energy on the high temperature zone and low temperature zone is implemented to maximize thermal and overall efficiency of recovering power in each cycle and of the overall AT ORC.

6 Claims, 1 Drawing Sheet

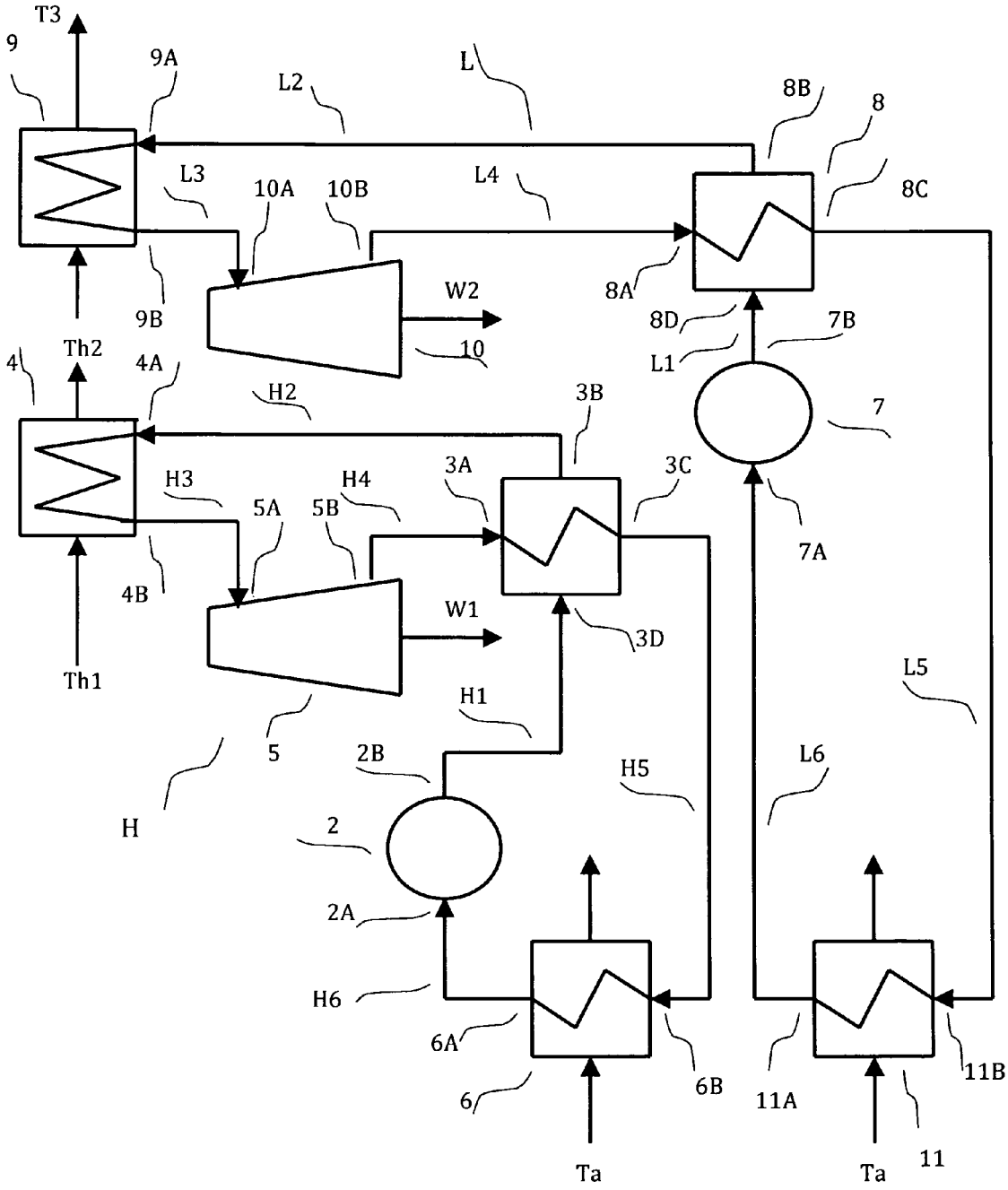
T3
9
9A
L2
L
8B
8
L3
10A
10B
L4
8C
9B
W2
8A
8D
7B
10
L1
4
Th2
4A
H2
3B
7
H3
H4
3A
3C
5A
5B
7A
4B
W1
3D
Th1
L5
H1
5
2B
H5
L6
H
2
2A
H6
6A
6B
11B
6
11A
11
Ta
Ta

ADVANCED TANDEM ORGANIC RANKINE CYCLE

CROSS-REFERENCE TO RELATED APPLICATION

This application claims the benefit of Provisional Patent Application Ser. No. 61/402,111, filed Aug. 24, 2010 by the present inventors.

STATEMENT REGARDING FEDERALLY SPONSORED RESEARCH OR DEVELOPMENT

Not Applicable

BACKGROUND OF THE INVENTION

The following is a tabulation of some prior art that presently appears relevant:

U.S. patents

| Pat. No. | Kind Code | Issue Date | Patentee |
|---|---|---|---|
| 6,571,548 | B1 | Jun. 03, 2003 | Bronicki et al |
| 6,857,268 | B2 | Feb. 22, 2005 | Stinger et al |
| 7,096,665 | B2 | Aug. 29, 2006 | Stinger et al |
| 7,942,001 | B2 | May 17, 2011 | Radcliff et al |

U.S. patent application Publications

| Publication Number | Kind Code | Publication Date | Applicant |
|---|---|---|---|
| 2008/0289313 | A1 | Nov. 27, 2008 | Batscha et al |
| 2010/0242479 | A1 | Sep. 30, 2010 | Ast et al |
| 2010/0071368 | A1 | Mar. 25, 2010 | Kaplan et al |
| 2010/0263380 | A1 | Oct. 21, 2010 | Biederman et al |

Nonpatent Literature Documents

F. David Doty, Siddarth Shevgoor, "A dual-source organic Rankine cycle (DORC) for improved efficiency in conversion of dual low- and mid-grade heat sources", ASME 2009 3$^{rd}$ International Conference of Energy Sustainability.

G. Angelino, P. Colonna di Paliano, "Organic Rankine Cycles (ORCs) for energy recovery from molten carbonate fuel cells", 35$^{th}$ Intersociety Energy Conversion Engineering, July 2000.

H. M. Leibowitz, Presentation "Generating Electric Power from Compressor Station Residual Heat using ORC Technology", 2002, Manager of the Heat Recovery Systems, Ormat International.

Eric W. Lemmon and Mark O. McLinden "Thermodynamic Properties of Propane. III A Reference Equation of State for Temperatures from the Melting Line to 650 K and Pressure up to 1000 MPA", Journal of Chemical & Engineering Data 2009, 54, 3141-3180

Organic Rankine Cycle (ORC) is using widely to generate power from sources of heat energy with the temperature up to 500° C.

For example gas turbines with natural gas as fuel are used to drive gas compressors of natural gas pipelines. The temperature of exhaust gas from the gas turbine reaches up to 500° C. The efficiency of the modern gas turbines is around 40%-42%. It means that up to 60% of thermal energy of natural gas goes with thermal and chemical pollutions to the atmosphere that partially could be used to generate additional power.

The main equipment of the fundamental ORC is comprised of a heater-vaporizer thermally connected to a source of heat energy, an expansion turbine, and a condenser thermally connected to a source of a coolant medium, and a pump of organic liquid. These pieces of the equipment are connected in a closed loop by piping and organic fluid is pumped through that closed loop. In an ORC process organic fluid has changed phases in the following order:

- the pressurized organic liquid phase flowing from the outlet of the pump to the inlet of the heater-vaporizer, where transforming to the pressurized heated organic vapor phase, flowing in the pipe connected to the outlet of a heater-vaporizer and the inlet of an expansion turbine,
- the depressurized organic vapor phase flowing in the pipe connected to the outlet of the expansion turbine and the inlet of the condenser there transforming it to the depressurized liquid phase, flowing in the pipe connected to the outlet of a condenser and suctioning to the inlet of the pump.

Generated power at the expansion turbine depends upon the thermal efficiency of the ORC. Various methods and processes are used to improve the efficiency of ORC. Prior art ORC systems have used the process of the recuperation of residual heat energy contained in depressurized vapor at the outlet of the expansion turbine which included two main directions:

1. Using Residual Heat Energy Contained in the Flow of Depressurized Vapor to Preheat Organic Liquid, Which is Pumped to the Heater-Vaporizer.

Using a high temperature source of heat energy for direct heating of organic fluid (through a heat exchanger) could be restricted for some types of organic fluids because of their low thermal stability at high temperature. In this case an intermediate loop with thermal oil and/or mixing exhaust gas with ambient air are used to decrease the temperature of the original high temperature source and transfer heat energy from this source to ORC. This direction reduces the top temperature of the organic cycle and decreases the available thermal efficiency of ORC. (G. Angelino "Medium Temperature 100 kW ORC Engine for total Energy Systems", Energy Conservation in Industry-Combustion, Heat Recovery, and Rankine Cycle Machines, 1982, D. Reidel Publishing Company, Dordrecht/Boston/Lancaster; U.S. Pat. No. 6,571,548 B1 to Bronicki, 2003, which are incorporated herein by reference.)

2. Transferring Residual Heat Energy Contained in the Flow of Depressurized Organic Vapor from a High Temperature Closed Loop to Preheat and Vaporize the Organic Fluid in a Low Temperature Closed Loop.

Propane and toluene have high thermal stability and could adapt heat without the intermediate loop mention above. It will increase the thermal efficiency of ORC. Transferring residual heat energy from the high temperature closed loop with the high thermal efficiency to the low temperature closed loop with the lower thermal efficiency decreases overall efficiency of ORC. (U.S. Pat. No. 6,857,268 B2 to Stinger, 2005; U.S. Pat. No. 7,096,665 B2 to Stinger, 2006; U.S. Pat. No. 7,942,001 to Radcliff, 2011; U.S. Patent Application Publication No. 2010/0263380 A1 to Biederman, 2010; U.S. Patent Application Publication No. 2010/0071368 A1 to Kaplan, GB20102457266 A to Kenneth, which are incorporated herein by reference.)

The invention U.S. Pat. No. 6,571,548 B1 was used for the Gold Creek Project to utilize heat energy of exhaust gas from RB211 turbine using thermal oil in the intermediate loop. This ORC Power Plant has 14% of net efficiency according to the Presentation "Generating Electric Power from Compressor Station Residual Heat using ORC Technology", 2002 by H. M. Leibowitz, Manager of the Heat Recovery Systems, Ormat International, which is incorporated herein by reference.

Stinger in the U.S. Pat. No. 6,857,268 B2 "Cascading Closed Loop" showed the net efficiency up to 20% of the Organic Rankine Cycle Power Plant because direct heating of organic fluid that has thermal stability at the temperature of the source of heat energy is used in this ORC PP, which is incorporated herein by reference.

It is well known from thermodynamics that the thermal efficiency of the cycle is increased with increasing the top temperature of ORC. It means that ORC would be more efficient if the organic vapor is heated up to the allowable temperature limited by the thermal stability. (F. David Doty, Siddarth Shevgoor, "A dual-source organic Rankine cycle (DORC) for improved efficiency in conversion of dual low- and mid-grade heat sources", ASME 2009 3rd International Conference of Energy Sustainability, which is incorporated herein by reference.)

The liquid propane is used widely in industry and could be used as an organic fluid in ORC that is thermally connected to the high temperature source of heat energy because its thermal stability has been approved up to 377° C., according to the publication of Eric. W. Lemmon "Thermodynamic Properties of Propane. III. A Reference Equation of State for Temperatures from the Melting Line to 650° K. and Pressure up to 1000 MPa", Journal of Chemical & Engineering Data, 2009, 54, 3141-3180 and U.S. Pat. No. 6,857,268 B2 to Stinger, which are incorporated herein by reference.

BRIEF SUMMARY OF THE INVENTION

In a first embodiment of an Advanced Tandem Organic Rankine Cycle (AT ORC) provides a method for generating power with improved thermal efficiency and overall efficiency of ORC. This method comprises:

separating Organic Rankine Cycle into a high temperature cycle and a low temperature cycle realized in a high temperature closed loop of Organic Rankine Cycle and a low temperature closed loop of Organic Rankine Cycle respectively, dividing the source of heat energy on a high temperature zone connected thermally to the high temperature closed loop and a low temperature zone connected thermally to the low temperature closed loop, determining a maximum of the top temperature (Th1−ΔT'sh) of the high temperature cycle to maximize the thermal efficiency of the generation of a first portion of useful power in the high temperature cycle, where:

Th1—maximum temperature of the source of heat energy in the high temperature zone, ΔT'sh=Th1−Ths—temperature approach on an outlet of the o high temperature superheater, Ths—temperature of an organic fluid at the outlet of the high temperature superheater, determining a maximum of the temperature range (Th1-Th2(min)) of the high temperature zone to maximize the overall efficiency of generation of the first portion of useful power in the high temperature cycle, where Th2(min)—maximum temperature in the low temperature zone, determining the maximum of the top temperature (Th2(min)−ΔT"sh) of the low temperature cycle to maximize the thermal efficiency of generation of the second portion of useful power, where ΔT"sh=Th2(min)−Tls—temperature approach on an outlet of the low temperature superheater, Tls—temperature of an organic fluid at the outlet of the low temperature superheater, determining a maximum of the temperature range (Th2(min)-Th3(min)) of the low temperature zone to maximize overall efficiency of generation of the second portion of useful power, where Th3—minimum temperature in the low temperature zone, providing a first flow of pressurized organic fluid in the high temperature closed loop, providing a second flow of pressurized organic fluid in the low temperature closed loop, providing thermal independency between of the first flow of pressurized organic fluid in the high temperature closed loop and the second flow of pressurized organic fluid in the low temperature closed loop, providing superheating the first flow of pressurized and preliminary superheated organic vapor to adapt high temperature heat energy from the high temperature zone and increase the temperature of vapor up to the allowable level considering the thermal stability of the chosen organic fluid, providing the first flow of pressurized and superheated organic vapor with the increased temperature to a first expansion turbine, generating the first portion of useful power from the first expansion turbine in the process of expanding of pressurized superheated organic vapor to the depressurized superheated organic vapor with the pressure correlated to the minimum pressure of organic fluid at the ambient air temperature, providing a recuperation of residual high temperature heat energy from the first flow of depressurized superheated organic vapor inside the high temperature closed loop for preheating, vaporizing, and preliminary superheating of pressurized organic liquid pumped with the mass flow operated in the high temperature closed loop, condensing depressurized organic vapor under the pressure correlated to the pressure of organic vapor at the ambient air temperature and returning the condensate in the liquid phase to the cycle of the high temperature closed loop under pressure of the first pump, providing superheating of the second flow of pressurized and preliminary superheated organic vapor in the low temperature zone to increase the temperature of superheated organic vapor, providing the second flow of pressurized and superheated organic vapor with increased temperature to a second expansion turbine in the low temperature closed loop, generating the second portion of useful power from a second expansion turbine in a process of expanding the pressurized superheated organic vapor to the depressurized superheated organic vapor with a pressure correlated to the minimum pressure of organic fluid at the ambient air temperature, providing a recuperation of residual heat of depressurized superheated organic vapor inside the low temperature closed loop for preheating, vaporizing, and preliminary superheating of pressurized organic liquid pumped with a mass flow operated in the low temperature closed loop, condensing depressurized organic vapor under the pressure correlated to the pressure of organic vapor at an ambient air temperature and return a condensate in the liquid phase to the cycle of the low temperature closed loop under pressure of the second pump, providing minimum and equal condensing temperatures of the first and second organic flows in the high temperature cycle and the low temperature cycle respectively to minimize heat losses in the first and second condensers determined by the ambient air temperature.

In this embodiment, wherein the organic fluid is propane or light hydrocarbons or a mix of light hydrocarbons with the thermal stability to allow heating this organic fluid up to 377° C. In this embodiment also, wherein the organic fluid is the same fluid in both the high temperature closed loop and the low temperature closed loop or the organic fluid is different fluids in the high temperature closed loop and the low temperature closed loop.

In another embodiment provides an apparatus for generating power with improved efficiency.

The apparatus of the high temperature closed loop comprises:

the first pump, the high temperature recuperator-vaporizer, the high temperature superheater, the first expansion turbine, the first condenser connected in series by piping adapted to contain the first flow of pressurized superheated organic vapor and pressurized organic liquid supplied by the first pump such that:

the outlet of the first pump is connected to the cold inlet of the high temperature recuperator-vaporizer, the hot outlet of the high temperature recuperator-vaporizer is connected to the inlet of the high temperature superheater which is located in the high temperature zone of the source of heat energy, the outlet of the high temperature superheater is connected to the inlet of the first expansion turbine which generates the first portion of power and is adapted to transfer power to a consumer, the outlet of the first expansion turbine is connected to the hot inlet of the high temperature recuperator-vaporizer that is adapted to transfer the residual heat of the depressurized superheated organic vapor to pressurized organic liquid supplied by the first pump, the cold outlet of the high temperature recuperator-vaporizer is connected to the inlet of the first condenser that is adapted to condense depressurized organic vapor with a minimum temperature Tc dependent on the ambient air temperature Ta and temperature approach $\Delta T'c=Tc-Ta$ in process of condensing the depressurized organic vapor, the outlet of the first condenser is connected to the suction of the first pump that is adapted to return the first flow of organic fluid to the high temperature closed loop.

The apparatus of the low temperature closed loop comprises:

the second pump, a low temperature recuperator-vaporizer, a low temperature superheater, the second expansion turbine, and the second condenser connected in series with multiple piping adapted to contain the second flow of pressurized superheated organic vapor and pressurized organic liquid supplied by the second pump such that:

the outlet of the second pump is connected to the cold inlet of the low temperature recuperator-vaporizer, the hot outlet of the low temperature recuperator-vaporizer is connected to the inlet of the low temperature superheater which is located in the low temperature zone of the source of heat energy, the outlet of the low temperature superheater is connected to the inlet of the second expansion turbine which generates the second portion of power and is adapted to transfer power to a consumer, the outlet of the second expansion turbine is connected to the hot inlet of the low temperature recuperator-vaporizer that is adapted to transfer the residual heat of the depressurized superheated organic vapor to the pressurized organic liquid supplied by the second pump, the cold outlet of the low temperature recuperator-vaporizer is connected to the inlet of the second condenser that is adapted to condense depressurized organic vapor with the minimum temperature Tc dependent on the ambient air temperature Ta and temperature approach $\Delta T''c=Tc-Ta$ in a process of condensing the depressurized organic vapor, the outlet of the second condenser which is connected to the suction inlet of the second pump that is adapted to return the second flow of organic fluid to the low temperature closed loop.

As the result of improvements of Organic Rankine Cycle for the source of high temperature heat energy the Advanced Tandem Organic Rankine Cycle generates power with increased net overall efficiency to at least 22% at the ambient air temperature 15° C.

Still further advantages will become apparent according to the following drawing and description.

BRIEF DESCRIPTION OF DRAWING

FIG. 1 is the schematic process diagram of the Advanced Tandem Organic Rankine Cycle reflecting the first and second embodiments.

DRAWING—REFERENCE NUMERALS

High Temperature Closed Loop H:

2—first pump
2A—suction inlet of the first pump
2B—outlet of the first pump
3—high temperature recuperator-vaporizer
3A—hot inlet of the high temperature recuperator-vaporizer
3B—hot outlet of the high temperature recuperator-vaporizer
3C—cold outlet of the high temperature recuperator-vaporizer
3D—cold inlet of the high temperature recuperator-vaporizer
4—high temperature superheater
4A—inlet of the high temperature superheater
4B—outlet of the high temperature superheater
5—first expansion turbine
5A—inlet of the first expansion turbine
5B—outlet of the first expansion turbine
6—first condenser
6A—outlet of the first condenser
6—inlet of the first condenser
H1, H2, H3, H4, H5, H6—piping of the high temperature closed loop
Th1, Th2—temperatures of the flow of heat energy in the high temperature zone
Ta—temperature of the flow of the coolant medium through the first condenser
W1—first portion of power transferred from the first expansion turbine to the consumer Low Temperature Closed Loop L:

7—second pump
7A—suction inlet of the second pump
7B—outlet of the second pump
8—low temperature recuperator-vaporizer
8A—hot inlet of the low temperature recuperator-vaporizer
8B—hot outlet of the low temperature recuperator-vaporizer
8C—cold outlet of the low temperature recuperator-vaporizer
8D—cold inlet of the low temperature recuperator-vaporizer
9—low temperature superheater
9A—inlet of the low temperature superheater
9B—outlet of the low temperature superheater
10—second expansion turbine

10A—inlet of the second expansion turbine
10B—outlet of the second expansion turbine
11—second condenser
11A—outlet of the second condenser
11B—inlet of the second condenser
L1, L2, L3, L4, L5, L6—piping of low temperature closed loop
Th2, T3—temperatures of the flow of heat energy in the low temperature zone
Ta—temperature of the flow of the coolant medium through the second condenser
W2—second portion of power transferred from the second expansion turbine to the consumer

DETAILED DESCRIPTION OF THE INVENTION

Generating power in an efficient way from sources of heat energy is important as traditional energy sources are depleting and there is increasing thermal and chemical pollution of the environment. The Advanced Tandem Organic Rankine Cycle relates to the method and apparatus for efficiently converting heat energy with temperature up to 500° C. from one source of heat energy into usable power produced of the high temperature closed loop of the Organic Rankine Cycle that is thermally connected to the high temperature zone of the source of heat energy, and of the low temperature closed loop of the Organic Rankine Cycle that is thermally connected to the low temperature zone of the source of heat energy.

To ensure maximum of the thermal efficiency and overall efficiency of the high temperature closed loop three advantaged steps are developed:

providing the high temperature closed loop of the Organic Rankine Cycle with maximum top temperature (Th1−ΔT'sh), recuperation of residual heat energy from high temperature zone inside the high temperature closed loop of Organic Rankine Cycle, adapting maximum heat energy from the high temperature zone providing maximum range of difference temperatures Th1 and Th2 (min), where $$Th2(\min)=[(Th1-\Delta T'sh)\times(P'2/P'1)\hat{}(\gamma'-1)/\gamma'\times C'p2-(Ta+\Delta T'c+\Delta T'r)\times C'p3++(Ta+\Delta T'c)\times C'p4]\times 1/C'p5+\Delta T'sh,$$

ΔT'r=T'c−T'p—difference of temperatures of depressurized organic vapor T'c at the cold outlet of the high temperature recuperator and pressurized organic liquid T'p at the cold inlet of the high temperature recuperator-vaporizer, P'2—pressure of depressurized superheated organic vapor in the high temperature closed loop, P'1—pressure of pressurized superheated organic vapor directed to the first expansion turbine, γ'=C'p1/C'v1—a ratio of specific heats of the superheated organic vapor directed to the first expansion turbine, C'p2, C'p3, C'p4, C'p5—specific heats of organic fluid at the following points: at the inlet of the first expansion turbine, at the inlet of the first condenser, at the outlet of the first condenser, and at the inlet of the high temperature superheater respectively in the high temperature closed loop.

To ensure maximum efficiency of the low temperature closed loop of the Organic Rankine Cycle another three advantaged steps are also developed:

providing the low temperature closed loop of Organic Rankine Cycle with maximum top temperature (Th2(min)−ΔT"sh), recuperation of residual heat energy inside the low temperature closed loop of the Organic Rankine Cycle adapting maximum heat energy from the low temperature zone providing maximum range of difference between the temperatures Th2(min) and Th3(min), where:

$$Th3(\min)=[(Th2(\min)-\Delta T''sh)\times(P''2/P''1)\hat{}(\gamma''-1)/\gamma''\times C''p2-(Ta+\Delta T''c+\Delta T''r)\times\times C''p3+(Ta+\Delta T''c)\times 1/C''p4]\times 1/C''p5+\Delta T''sh>Tdp$$

ΔT"r=T"c−T"p difference of temperatures of depressurized organic vapor T"c at the cold outlet of the low temperature recuperator and pressurized organic liquid T"p at the cold inlet of the low temperature recuperator-vaporizer, Tdp—dew point temperature, P"2—pressure of depressurized superheated organic vapor in the low temperature closed loop, P"1—pressure of pressurized superheated organic vapor directed to the second expansion turbine, γ"=C"p1/C"v1—ratio of specific heats of superheated organic vapor directed to the second expansion turbine, C"p2, C"p3, C"p4, C"p5—specific heats of organic fluid at the following points: inlet of the second expansion turbine, the inlet of the second condenser, outlet of the second condenser, and to the inlet of the low temperature superheater respectively in the low temperature closed loop.

The high temperature closed loop H (FIG. 1) comprises:

organic fluid circulated in the high temperature closed loop H, high temperature superheater 4 thermally connected to the high temperature zone of the source of heat energy with the temperature range from maximum temperature Th1 to minimum temperature Th2, inlet 4A of high temperature superheater connected by pipe H2 to hot outlet 3B of high temperature recuperator-vaporizer 3, first expansion turbine 5 connected to the consumer of the first portion of power W1, inlet 5A of first expansion turbine 5 connected by pipe H3 to outlet 4B of high temperature superheater 4, high temperature recuperator-vaporizer 3, which cold inlet 3D is connected by pipe H1 to outlet 2B of first pump 2, hot inlet 3A is connected by pipe H4 to outlet 5B of first expansion turbine 5, and cold outlet 3C is connected by pipe H5 to inlet 6B of first condenser 6, first pump 2, which suction inlet 2A is connected by pipe H6 to outlet 6A of first condenser 6, first condenser 6 is thermally connected to coolant medium with temperature Ta.

The low temperature closed loop L (FIG. 1) comprises:

organic fluid circulated in the low temperature closed loop L, low temperature superheater 9 is thermally connected to the low temperature zone of the source of heat energy with the temperature range from maximum temperature Th2 to minimum temperature T3, inlet 9A of low temperature superheater 9 is connected by pipe L2 to hot outlet 8B of low temperature recuperator-vaporizer 8, second expansion turbine 10 is connected to the consumer of the second portion of power W2, inlet 10A is connected by pipe L3 to outlet 9B of low temperature superheater 9, low temperature recuperator-vaporizer 8, which cold inlet 8D is connected by pipe L1 to outlet 7B of second pump 7, hot inlet 8A is connected by pipe L4 to outlet 10B of second expansion turbine 10, and cold outlet 8C is connected by pipe L5 to inlet 11B of second condenser 11, second pump 7, which suction inlet 7A is connected by pipe L6 to outlet 11A of second condenser 11, second condenser 11 is thermally connected to coolant medium with temperature Ta.

Operation

Extracting the first portion of useful power from first expansion turbine 5 with the first flow of organic fluid in the high temperature closed loop H comprises:

the first flow of organic liquid with mass flow rate operated in the high temperature closed loop pressurized in first pump 2, the first flow of pressurized organic liquid preheated, vaporized and preliminary superheated in high temperature recuperator-vaporizer 3, increasing the temperature of preliminary superheated pressurized organic vapor in high temperature superheater 4 thermally connected to high temperature zone of the source of heat energy, expanding superheated pressurized organic vapor with increased temperature in first expansion turbine 5, which produces the first portion of power, and depressurized superheated organic vapor at outlet 5B, directing the first portion of power W1 from expansion turbine 5 to the consumer, directing depressurized superheated organic vapor to high temperature recuperator-vaporizer 3, where residual thermal energy of the depressurized organic vapor is transferred to a pressurized organic liquid of the first flow to preheat, vaporize and superheat it, directing depressurized organic vapor from cold outlet 3C of high temperature recuperator-vaporizer 3 to first condenser 6, where organic vapor is condensed to liquid and directed to suction inlet 2A of first pump 2, return organic fluid with mass flow operated in high temperature closed loop H to high temperature cycle.

Extracting the second portion of useful power from second expansion turbine 10 with the second flow of organic fluid in the low temperature closed loop L comprises:

the second flow of organic liquid with mass flow rate operated in low temperature closed loop pressurized in second pump 7, second flow of organic pressurized liquid preheated, vaporized and superheated in low temperature recuperator-vaporizer 8, increasing temperature of preliminary superheated pressurized organic vapor in low-temperature superheater 9, expanding pressurized superheater organic vapor in second expansion turbine 10, which produces the second portion of useful power, and depressurized superheated organic vapor at outlet 10B, directing the second portion of power W2 from expansion turbine 10 to a consumer, directing depressurized superheated organic vapor to low temperature recuperator-vaporizer 8, where residual thermal energy of depressurized organic vapor is transferred to pressurized organic liquid of the second flow to preheat, vaporize and superheat it, directing depressurized organic vapor flow from cold outlet 8C of low temperature recuperator-vaporizer 8 to second condenser 11, where organic vapor is condensed to liquid and directed to suction inlet 7A of second pump 7, return organic fluid with the mass flow operated in the low temperature closed loop L to the low temperature cycle.

First expansion turbine 5 and second expansion turbine 10 can be connected in series or parallel to an electric generator or directly to a consumer of mechanical energy using a speed-changing device if it is necessary.

The present embodiments can be modified within the basic idea to include additional heat exchangers, condensers, pumps or expansion turbines. Alternate arrangements and configurations can be also used to connect expansion turbines to a consumer of power.

We claim:

1. A method for generating power with improving thermal and overall efficiencies of Organic Rankine Cycle using a source of heat energy, said method comprising:

a. separating said Organic Rankine Cycle into two cycles: a high temperature cycle realized in a high temperature closed loop and a low temperature cycle realized in a low temperature closed loop;

b. dividing said source of heat energy into a high temperature zone connected thermally to said high temperature closed loop and a low temperature zone connected thermally to said low temperature closed loop;

c. determining a maximum of the top temperature (Th1−ΔT'sh) of said high temperature cycle to maximize the thermal efficiency in generation of a first portion of power;

d. determining a maximum of the temperature range (Th1-Th2(min)) of said high temperature zone to maximize the overall efficiency in generation of the first portion of power, where Th2(min) is:

$$Th2(\min)=[(Th1-\Delta T'sh)\times(P'2/P'1)\hat{}(\gamma'-1)/\gamma'\times C'p2-(Ta+\Delta T'c+\Delta T'r)\times C'p3+(Ta+\Delta T'c)\times C'p4]\times 1/C'p5+\Delta T'sh$$

Where:

Th1—maximum temperature of the source of heat energy in said high temperature zone, Th2(min)—maximum temperature in said low temperature zone, ΔT'sh=Th1−Ths—temperature approach of first flow of pressurized superheated organic vapor with temperature Ths from an outlet of a high temperature superheater, ΔT'c—difference of temperature of condensed organic fluid flowing from an outlet of a first condenser and temperature of a coolant medium, ΔT'r—difference of temperature of depressurized organic vapor at the cold outlet of a high temperature recuperator and temperature of pressurized organic liquid at the cold inlet of said high temperature recuperator, Ta—ambient air temperature, P'2—pressure of depressurized superheated organic vapor in said high temperature closed loop, P'1—pressure of pressurized superheated organic vapor directed to a first expansion turbine, γ'=C'p1/C'v1—ratio of specific heats of pressurized superheated organic vapor directed to said first expansion turbine, C'p2, C'p3, C'p4, C'p5—specific heats of organic fluid directed to said first expansion turbine, the inlet of said first condenser, from the outlet of said first condenser, and the inlet of said high-temperature superheater respectively in said high temperature closed loop;

e. determining a maximum of the top temperature (Th2−ΔT"sh) of said low temperature cycle to maximize thermal efficiency in generation of a second portion of power;

f. determining a maximum temperature range (Th2(min)−Th3(min)) of said low temperature zone to maximize overall efficiency in generation of said second portion of power, where Th3(min) is minimum temperature of said low temperature zone according to the equation:

$$Th3(\min)=[(Th2(\min)-\Delta T''sh)\times(P''2/P''1)\hat{}(\gamma''-1)/\gamma''\times C''p2-(Ta+\Delta T''c+\Delta T''r)\times\times C''p3+(Ta+\Delta T''c)\times C''p4]\times 1/C''p5+\Delta T''sh>Tdp$$

Where:

ΔT"sh=Th2(min)—Tls—temperature approach of the second flow of pressurized superheated organic vapor with temperature Tls from an outlet of a low temperature superheater, ΔT"c—difference of temperature of condensed organic fluid flowing from an outlet of a second condenser and temperature of a coolant medium, ΔT"r—difference of temperature of depressurized organic vapor at the cold outlet of a low temperature recuperator and temperature of pressurized organic liquid at cold inlet of said low temperature recuperator, Ta—ambient air temperature, Tdp—dew point temperature, P"2—pressure of depressurized superheated organic vapor in said low temperature closed loop, P"1—pressure of pressurized superheated organic vapor directed to a second expansion turbine, γ"=C"p1/C"v1—ratio of specific heats of superheated organic vapor directed to said second expansion turbine, C"p2, C"p3, C"p4, C"p5—specific heats of organic fluid directed to said second expansion turbine, to the inlet of said second condenser, from the outlet of said second condenser, and to the inlet of said low temperature superheater respectively in said low temperature closed loop;

g. providing the first flow of pressurized organic fluid in said high-temperature closed loop;

h. providing the second flow of pressurized organic fluid in said low-temperature closed loop;

i. providing thermal independency between said first flow of pressurized organic fluid and said second flow of pressurized organic fluid;

j. providing preheating, vaporizing and preliminary superheating of said first flow of pressurized organic liquid in the process of recuperation in said high temperature closed loop;

k. adapting heat energy from said high temperature zone and increasing the temperature of pressurized and preliminary superheated organic vapor up to allowable temperature considering the thermal stability of the chosen organic fluid;

l. providing said first flow of pressurized and superheated organic vapor to said first expansion turbine in said high temperature closed loop;

m. generating the first portion of power on said first expansion turbine in a process of expanding said first flow of pressurized superheated organic vapor flowing through said first expansion turbine;

n. providing said first flow of depressurized superheated organic vapor from downstream of said first expansion turbine to said high temperature recuperator under pressure correlated to pressure of organic fluid at ambient air temperature;

o. providing the process of recuperation of residual high temperature heat energy from said first flow of superheated and depressurized organic vapor inside said high temperature closed loop for preheating, vaporizing, and preliminary superheating pressurized organic liquid pumped with mass flow operated in said high temperature closed loop;

p. producing condensate from depressurized organic vapor under pressure correlated to critical pressure of organic vapor at an ambient air temperature and returning condensate in the liquid phase under pressure of a first pump to said high temperature cycle of said high temperature closed loop;

q. providing preheating, vaporizing and preliminary superheating of a second flow of pressurized organic liquid in the process of recuperation in said low temperature closed loop;

r. adapting heat energy from said low temperature zone and increasing a temperature of pressurized and preliminary superheated organic vapor up to allowable temperature considering the thermal stability of chosen organic fluid;

s. providing said second flow of pressurized and superheated organic vapor with increased temperature to a second expansion turbine;

t. generating the second portion of power on said second turbine in the process of expanding second flow of pressurized and superheated organic vapor flowing through said second expansion turbine;

u. providing said second flow of expanded depressurized superheated organic vapor from downstream of said second expansion turbine to said low temperature recuperator under pressure correlated to critical pressure of organic fluid at an ambient air temperature;

v. providing the process of recuperation of residual heat of expanded superheated and depressurized organic vapor inside said low temperature closed loop for preheating, vaporizing, and preliminary superheating pressurized organic fluid pumped with a mass flow operated in said low temperature closed loop;

w. producing condensate from depressurized organic vapor under pressure correlated to critical pressure of organic vapor at an ambient air temperature and returning said condensate in the liquid phase under pressure of a second pump to said low temperature cycle of said low temperature closed loop;

x. providing minimum and equal condensing temperatures of said first and second flows of organic fluids in said high temperature cycle and low temperature cycle respectively to minimize heat losses in first and second condensers determined by the ambient air temperature.

2. A method as claimed in claim 1 wherein said organic fluid is propane with allowable temperature of heating of said fluid up to 377° C. considering propane thermal stability.

3. A method as claimed in claim 1 wherein said organic fluid is selected from the group of light hydrocarbons or combination of these light hydrocarbons with said thermal stability allowing to increase temperature of heating of said fluid up to 377° C.

4. A method as claimed in claim 1 wherein said organic fluid is the same fluid in said high temperature closed loop and in said low temperature closed loop.

5. A method as claimed in claim 1 wherein said organic fluid is different fluids in said high temperature closed loop and in said low temperature closed loop.

6. An apparatus for generating power, said apparatus comprising:

high temperature closed loop with first flow of organic fluid, and low-temperature closed loop with second flow of organic fluid thermally separated from each other by a high temperature super heater thermally connected to high temperature zone and a low temperature super heater thermally connected to low temperature zone of said source of heat energy;

said high temperature closed loop with multiple piping adapted to contain first flow of pressurized superheated vapor and pressurized organic liquid supplied by first pump, connected in series such that:

the outlet of said first pump connected to cold inlet of a high temperature recuperator-vaporizer, which is adapted to transfer pressurized organic liquid into pressurized and preliminary superheated organic vapor using residual heat energy contained in the depressurized superheated organic vapor from the outlet of first expansion turbine;

hot outlet of said high temperature recuperator-vaporizer connected to the inlet of said high temperature superheater adapted to increase the temperature of pressurized and preliminary superheated organic vapor;

the outlet of said high temperature superheater connected to the inlet of said first expansion turbine adapted to generate first portion of power and transfer said portion of power to the consumer;

the outlet of said first expansion turbine connected to the hot inlet of said high temperature recuperator-vaporizer adapted to transfer residual heat of depressurized superheated organic vapor to pressurized organic liquid supplied by said first pump;

cold outlet of said high temperature recuperator-vaporizer connected to the inlet of first condenser adapted to condense depressurized organic vapor with minimum temperature determined at the ambient temperature and temperature difference at the outlet of first condenser;

the outlet of said first condenser connected to suction inlet of said first pump adapted to return said first flow of organic fluid to said high temperature closed loop;

said low temperature closed loop with multiple piping adapted to contain second flow of pressurized superheated vapor and pressurized organic liquid supplied by the second pump, connected in series such that:

the outlet of second pump is connected to the cold inlet of said low temperature recuperator-vaporizer, which is adapted to transfer pressurized organic liquid into pressurized and preliminary superheated organic vapor using residual heat energy contained in the depressurized superheated organic vapor from the outlet of said second expansion turbine;

hot outlet of a low temperature recuperator-vaporizer connected to the inlet of said low temperature superheater adapted to increase temperature of pressurized and preliminary superheated organic vapor;

the outlet of said low temperature superheater connected to the inlet of said second expansion turbine adapted to generate the second portion of power and transfer said portion of power to the consumer;

the outlet of said second expansion turbine connected to the hot inlet of said low temperature recuperator-vaporizer adapted to transfer residual heat of depressurized superheated organic vapor to pressurized organic liquid supplied by said second pump;

the cold outlet of said low temperature recuperator-vaporizer connected to the inlet of second condenser adapted to condense depressurized organic vapor with minimum temperature determined at the ambient temperature and said temperature approach at the outlet of second condenser;

the outlet of said second condenser connected to the suction inlet of said second pump adapted to return said second flow of organic fluid to said low temperature closed loop.

* * * * *